US006811044B2

(12) United States Patent
Walker

(10) Patent No.: US 6,811,044 B2
(45) Date of Patent: Nov. 2, 2004

(54) SHELF LINER

(76) Inventor: Brian Walker, 20311 - 215th Ave., Big Lake, MN (US) 55309

( * ) Notice: Subject to any disclaimer, the term of this patent is extended or adjusted under 35 U.S.C. 154(b) by 0 days.

(21) Appl. No.: 10/255,497

(22) Filed: Sep. 26, 2002

(65) Prior Publication Data

US 2004/0060883 A1 Apr. 1, 2004

(51) Int. Cl.[7] ..... A47F 5/00

(52) U.S. Cl. ..... 211/119.003; 211/86.01; 211/184; 40/642.02

(58) Field of Search ..... 211/119.003, 86.01, 211/183, 59.2, 59.3, 184; 40/649, 299.01, 642.02

(56) References Cited

U.S. PATENT DOCUMENTS 2,639,040 A * 5/1953 Tapley
2,688,201 A * 9/1954 Troendle
3,320,690 A * 5/1967 Forsburg
4,140,224 A * 2/1979 Celeste
5,341,945 A * 8/1994 Gibson ..... 211/184
5,992,072 A * 11/1999 Garfinkle ..... 40/642.02
6,041,720 A * 3/2000 Hardy ..... 211/184 X
6,227,385 B1 5/2001 Nickerson ..... 211/59.3
6,409,028 B2 6/2002 Nickerson ..... 211/59.3
6,571,498 B1 * 6/2003 Cyrluk ..... 211/119.003 X
6,632,316 B1 * 10/2003 Garvic ..... 40/642.02

* cited by examiner

*Primary Examiner*—Robert W. Gibson, Jr.
(74) *Attorney, Agent, or Firm*—Jacobson and Johnson

(57) ABSTRACT

A shelf liner comprising a base for engaging a surface of a shelf, a panel secured to the base with the panel having at least two display areas for displaying information, in one embodiment a plurality of lips located on the panel slidably secures a first information strip to the first display area and slidably secures a second information strip to the second display area and in a further embodiment, a set of sidewall dividers having an elongated portion member are secured to the opposite sides of the base for forming a compartment therebetween.

19 Claims, 4 Drawing Sheets

SHELF LINER

FIELD OF INVENTION

The present invention relates to display shelves, and more specifically, to a liner for a display shelf comprising a base for supporting products thereon and a panel having a plurality of display areas for displaying information.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of shelf liners is known in the art. Shelf liners permit users, such as those in the department or grocery store industry, to decoratively organize their products for display and sale. Shelf liners typically comprise a base for supporting products thereon and some type of barrier located at the edge of the base of the shelf liner to help retain the product thereon. For example, U.S. Pat. No. 6,227,385 discloses a shelf tray system having an insert secured to the front track of the shelf tray system for retaining product behind the front track with the insert being made of a clear acrylic so that the insert does not interfere with a shopper's view of the product.

It is also know in the art to place signs containing information regarding the product being displayed, such as the brand name of the product and the price of the product, within the vicinity of the shelf liner for informative purposes. Typically, these signs are placed just above the products or on the base of the shelf liner along with the product, which often blocks the view of the product due to the size constraints of the shelves.

The present invention provides for a shelf liner, which can be used in conjunction with a display shelf to provide support for products being display such as those in a department or grocery store while also providing an enhanced product information region for the display of information such as information regarding the product being support thereon without interfering with a viewer's view of the product being displayed.

SUMMARY OF THE INVENTION

Briefly, the present invention is a shelf liner comprising a base for engaging a surface of a shelf and a panel secured to the base. The panel includes at least two display areas for securing and displaying information thereon. The present invention can also include a set of sidewall dividers secured along the sides of the base for forming a compartment therebetween. An advantage of the present invention is that the present invention provides support for products being display while simultaneously providing an enhance product information display area without hindering a person's view of the product being displayed.

DESCRIPTION OF THE PREFERRED EMBODIMENT

Figure 1:
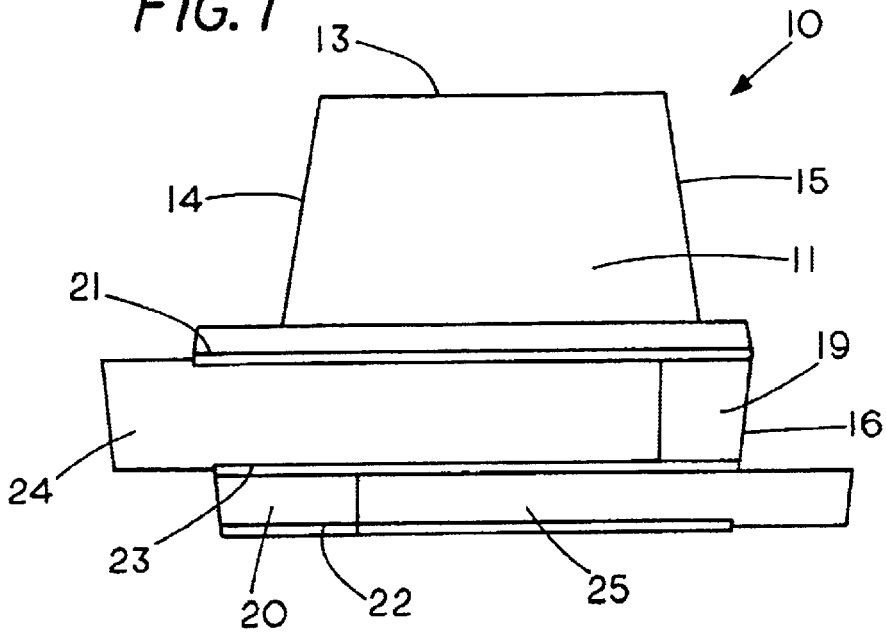
FIG. 1 shows a perspective front view of a shelf liner of the present invention.
Figure 2:
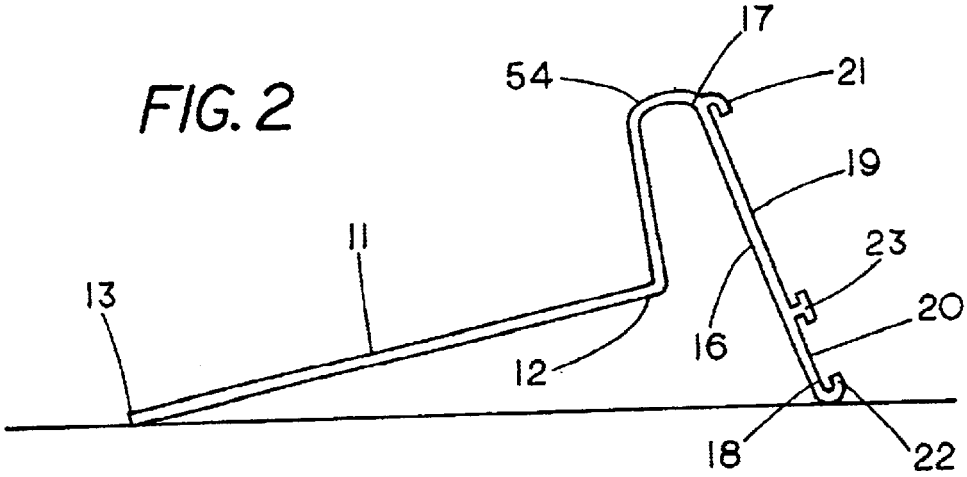
FIG. 2 shows a side view of the shelf liner of FIG. 1.

Referring to FIG. 1, reference numeral 10 identifies a shelf liner of the present invention. Shelf liner 10 comprises a rigid, rectangular base 11 for supporting products thereon and a panel 16 for displaying information thereon, such as information regarding the product support by base 11. Base 11 includes a first end 12 (shown in FIG. 2), a second end 13, a first side 14 and a second side 15. Referring to FIGS. 1 and 2, panel 16 includes a first upper edge 17, a second lower edge 18, a first elongated display area 19 and a second elongated display area 20. Panel 16 also includes a first panel lip 21 and a second panel lip 22 with first panel lip 21 being spaced from second panel lip 22. Also located on panel 16 and spaced between first panel lip 21 and a second panel lip 22 is a T-shaped lip 23. T-shaped lip 23 is more clearly shown in FIG. 2. T-shaped lip 23 is shown in FIG. 1 coacting with first panel lip 21 to slidingly secure a first information strip 24 to the first display area 19 and coacting with second panel lip 22 to slidingly secure a second information strip 25 to second display area 20.

Although the embodiment of FIG. 1 shows panel 16 having two display areas 19 and 20, alternative embodiments of the present invention may include a panel having more than two display areas for the display of information. As such, the number of information strips and the number of panel lips will correspond to the number of display areas that the panel of the alternate embodiment may contain.

In addition, instead of the use of information strips for the displaying of information on the display areas, alternative embodiment of the present invention may include a panel having display areas composed of an erasable medium such as a slate board or an erasable marker board for the displaying of information thereon which may later be changed or erased.

FIG. 2 shows a side view of FIG. 1. In FIG. 2, a L-shaped member 54 is shown securing base 11 to panel 16 with base 11 positioned at an acute angle with respect to the portion of panel 16 located proximate the first end 17 of panel 16 and with base 11 positioned at an obtuse angle with respect to the portion of panel 16 located proximate the second end 18 of panel 16. L-shaped member 54 functions not only for securing base 11 to panel 16 but also for aiding to retain products being supported by base 11 thereon.

Alternatively, instead of base 11 being secured to panel 16 by L-shaped member 54, alternative embodiments may have base 11 directly secured to panel 16 to provide panel 16 with the dual purpose of aiding to retain products on base 11 while also providing for the display of information thereon. Although the embodiment of FIG. 2 shows the first display area 19 having a larger surface area than the second display area 20, alternative embodiments may include the first display area having a smaller surface area then the second display area or the first display area and the second display area having surface areas of the same or similar size.

Figure 3:
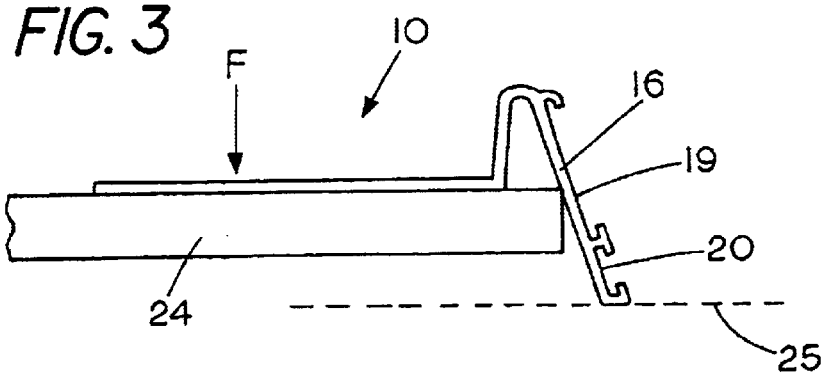
FIG. 3 shows a side view of a shelf liner supported on a horizontal shelf.

FIG. 3 is a side view showing shelf liner 10 supported on a horizontal shelf 24. As shown in FIG. 3, due to the non-perpendicular positioning of base 11 with respect to the panel 16 display areas 19 and 20 will be slanted at an angle with respect to a horizontal plane 25 so as to allow a viewer looking from above shelf liner 10 to obtain a clear view of display areas 19 and 20.

Figure 4:
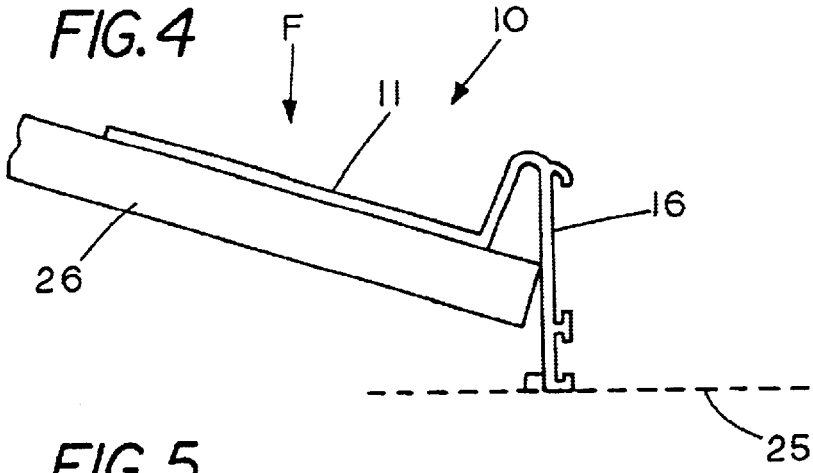
FIG. 4 shows a side view of a shelf liner supported on a downwardly angling shelf.

FIG. 4 is a side view showing shelf liner 10 supported on a downwardly angling shelf 26. As shown in FIG. 4, the non-perpendicular positioning of base 11 with respect to the portion of panel 16 compensates for the downwardly angling shelf 26 to hold the panel 16 in a vertical condition.

As shown in FIGS. 3 and 4, when shelf liner 10 supports a product on the shelves 24 and 26, a downward force F created by the weight of the product will not dislodge the shelf since the frictional resistance between the shelf and the base is sufficient to maintain shelf liner 10 in place on shelves 24 and 26. In addition, if desired a fastener can be used to further secure base 11 to shelf 26.

Figure 5:
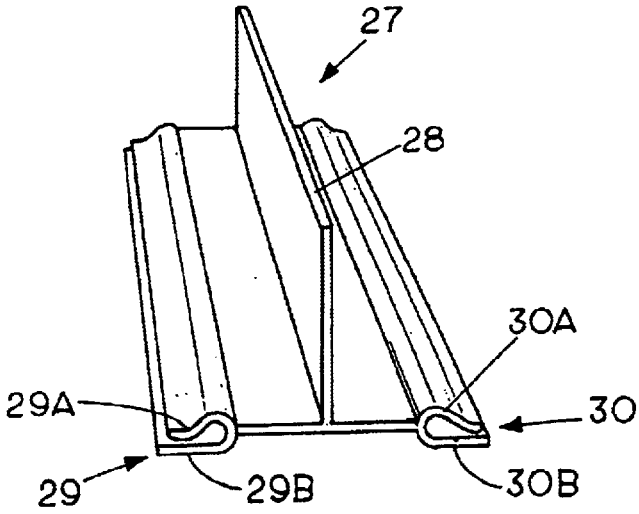
FIG. 5 shows a sidewall divider for securing along the sides of base of the shelf liner.

Referring to FIG. 5, FIG. 5 shows a sidewall divider 27 for securing to shelf liner 10 along the sides 14 and 15 of base 11 (shown in FIGS. 1 and 2). As shown in FIG. 5, sidewall divider 27 comprises a first securing member 29 having a first resilient lip 29A and a second resilient lip 29B, a second securing member 30 having a first resilient lip 30A and a second resilient lip 30B and an elongated member 28 located between first securing member 29 and second securing member 30. Securing members 29 and 30 are designed to secure sidewall divider 27 along the sides 14 and 15 of base 11. Sidewall divider 27 is secured along sides of base 11 through the frictional engagement of the first resilient lip 29A and second resilient lip 29B of the first securing member 29 to opposite faces of one of the sides of rigid base 11 and through the frictional engagement of the first resilient lip 30A and second resilient lip 30B of the second securing member 30 to opposite faces of the other side of rigid base 11. Although FIG. 5 shows sidewall divider 27 having lips for securing sidewall divider 27 to the shelf liner, alternative embodiments of the sidewall divider may include other methods for securing sidewall divider to the shelf liner such as through the use of pegs and lock or locking slots.

Figure 6:
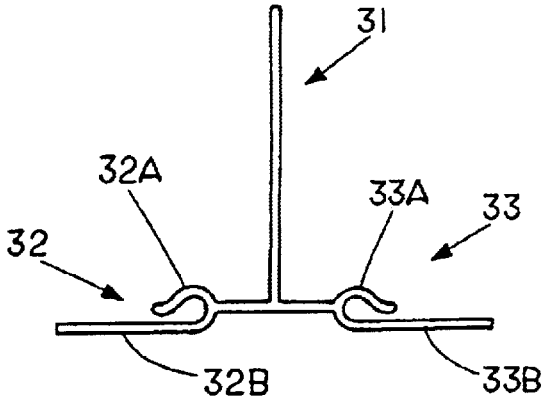
FIG. 6 shows an alternative embodiment of a sidewall divider comprising an elongated member and a pair of securing members both having extended second lips.
Figure 7:
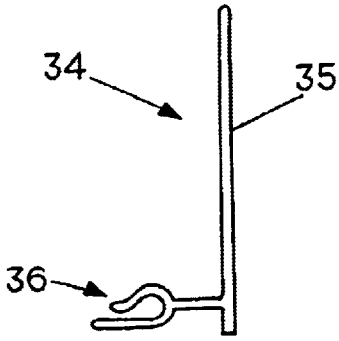
FIG. 7 shows an alternative embodiment of a sidewall divider comprising an elongated member and one securing member.

FIGS. 6 and 7 both show alternative embodiments of a sidewall divider. FIG. 6 shows a sidewall divider 31 having a first securing member 32 comprising a first resilient lip 32A and a second resilient lip 32B for frictionally engaging the base of a shelf liner and a second securing member 33 comprising a first resilient lip 33A and a second resilient lip 33B for frictionally engaging the base of a shelf liner. As shown in FIG. 6, the second resilient lip 32B of the first securing member 32 and the second resilient lip 33B of the second securing member 33 both have extended length such that both of their lengths are longer than the length of the first resilient lip 32A of first securing member 32 and the length of the first resilient lip 33A of the second securing member 33. The extended lengths of resilient lips 32B and 33B provide additional support for the securement of sidewall divider 31 along sides 14 and 15 of base 11. While both lips are described as being resilient, the present invention also works if only one of the lips is resilient.

Referring to FIG. 7, FIG. 7 shows for an alternative embodiment of a sidewall divider 34 having an elongated member 25 and one securing member 36. Sidewall divider 34 is design for use in which a user does not want to secure a second shelf liner to the sidewall divider 34 or in situation in which the presence of a second lip would prevent the use of the shelf liner due to a space constraint of the shelf.

Figure 8:
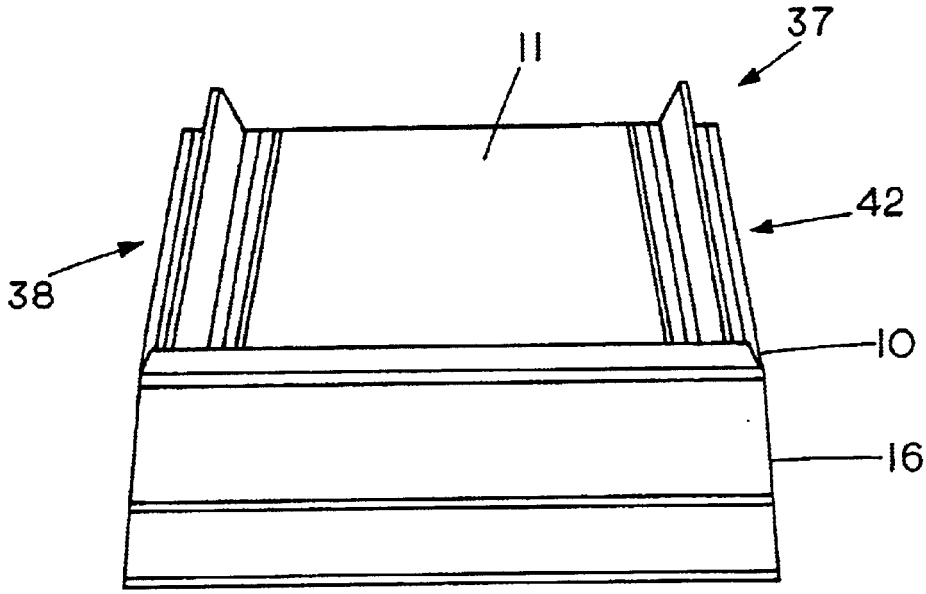
FIG. 8 shows a perspective front view of a shelf liner having a pair of sidewall dividers secured along the sides of the base of the shelf liner forming a compartment therebetween.
Figure 9:
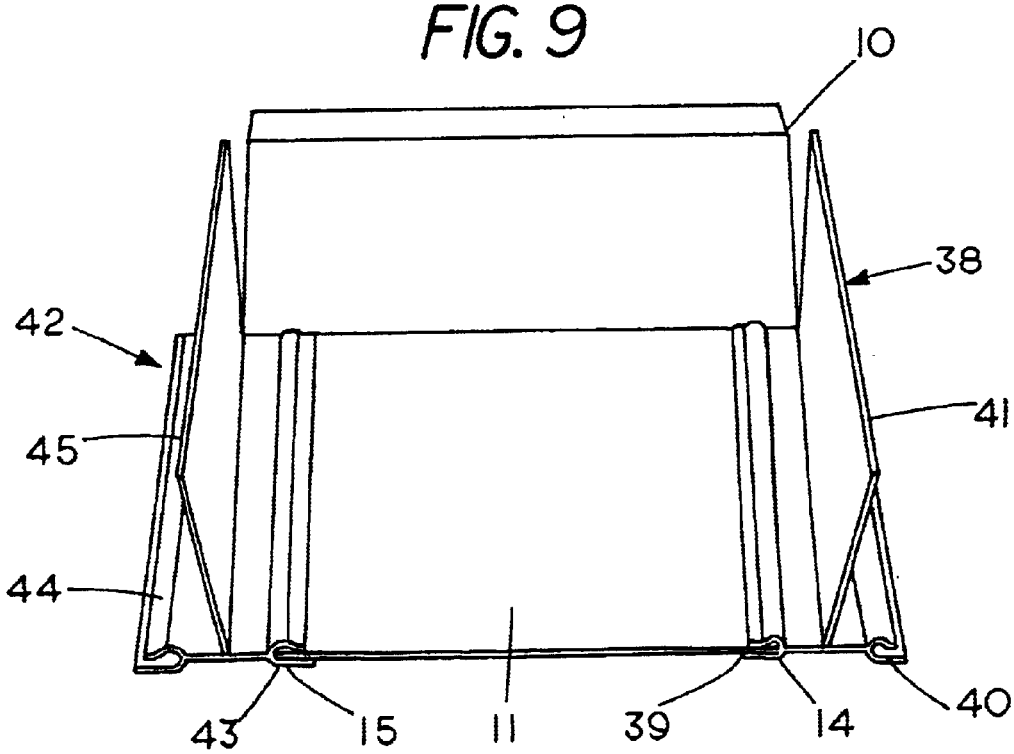
FIG. 9 shows a perspective rear view of a shelf liner having a pair of sidewall dividers secured along the sides of the base of the shelf liner forming a compartment therebetween.

Referring to FIG. 8 and FIG. 9, FIG. 8 shows a perspective front view and FIG. 9 shows a perspective rear view of a shelf liner 10 having a first sidewall divider 38 and a second sidewall divider 42 secured to shelf liner 10 along sides 14 and 15 of base 11 forming a compartment therebetween. As further shown in FIG. 9, securing member 39 of first sidewall divider 38 frictionally secures first sidewall divider 38 along the first side 14 of base 11 and the first securing member 43 of the second sidewall divider 42 frictionally secures second sidewall divider 42 along the second side 15 of base 11. The securement of the sidewall dividers 38 and 42 along the sides of base 11 results in an elongated member 41 of the first sidewall member 38 and an elongated member 45 of the second sidewall member 42 forming a compartment therebetween. Additional shelf liners may be secured to either a second securing member 40 of the first sidewall divider 38 or the second securing member 44 of the second sidewall divider 42 to form a series of shelf liner for supporting a plurality of products.

Figure 10:
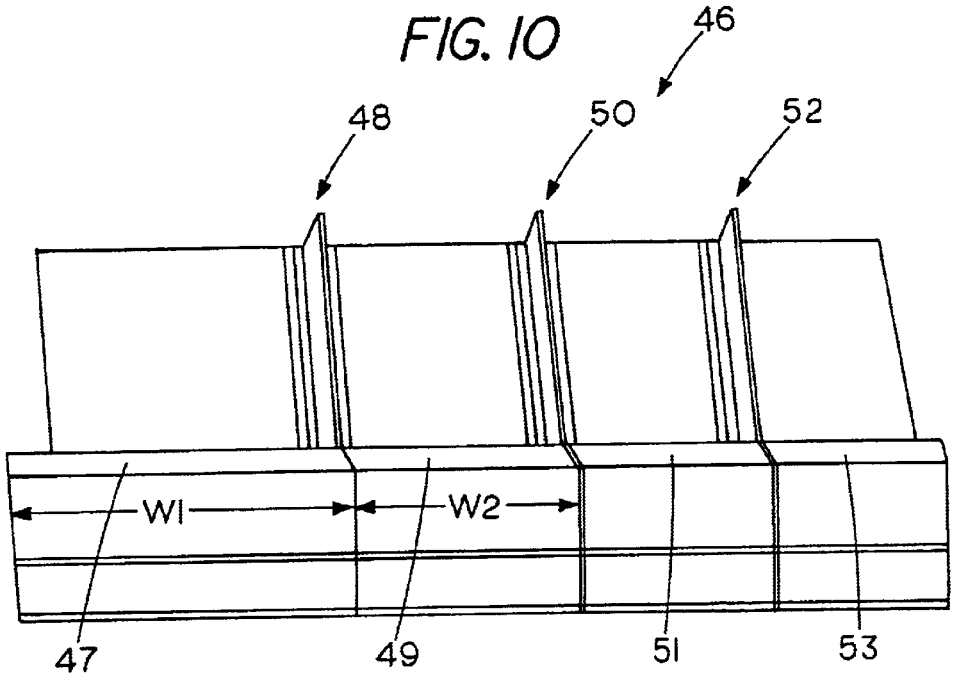
FIG. 10 is a perspective view showing a plurality of shelf liner connected to each other by a plurality of sidewall dividers.

FIG. 10 is a perspective view showing an assembly of shelf liners comprising a first shelf liner 47, a second shelf liner 49, a third shelf liner 51 and a forth shelf liner 53 secured to each other by a first sidewall divider 48, a second sidewall divider 50, and a third sidewall divider 52 to form a series of shelf liners for the support and the display of a plurality of products thereon. As shown in FIG. 10, shelf liners of varying sizes may be used in forming the series of shelf liners. For example, FIG. 10 show shelf liner 47 having a width $W_1$ and shelf liner 49 having a width of $W_2$ where $W_1$ is longer than $W_2$.

I claim:

1. A shelf liner comprising:

a base for engaging a surface of a shelf, said base providing a frictional resistance between the surface of said shelf and said base to maintain said shelf liner in place on said shelf, said base having a first edge, a second edge, a first side and a second side;

a panel having a first end and a second end, said panel having a plurality of display areas for displaying information; and an L-shaped member securing said panel to said base, said L-shaped member aiding to retain products being support by said base thereon.

2. The shelf liner of claim 1 including a plurality of lips located on said panel for slidably securing a plurality of strips containing product information to said display areas.

3. The shelf liner of claim 1 wherein said panel is secured to said base at an acute angle with respect to a portion said panel located proximate the first end of said panel.

4. The shelf liner of claim 1 wherein said base is located between the first end and the second end of said panel.

5. A shelf liner comprising:

a base for engaging a surface of a shelf, said base having a first edge, a second edge, a first side and a second side;

a panel having a first end and a second end, said panel secured to said base, said panel having a plurality of display areas for displaying information; and a first sidewall divider comprising an elongated member and a securing member having a set of resilient lips for frictionally engaging said base for securing said sidewall divider along the first side of said base.

6. The shelf liner of claim 2 wherein said plurality of display areas comprises a first display area and a second display area, said plurality of strips comprises a first strip containing information for securing to the first display area and a second strip containing information for securing to the second display area.

7. The shelf liner of claim 6 wherein said first display area has a larger surface area than said second display area.

8. The shelf liner of claim 5 including a second sidewall divider comprising an elongated member and a securing member having a first resilient lip and a second resilient lip for frictionally engaging the base to secure said sidewall divider along the first side of said base thereby forming a compartment between said sidewall dividers.

9. The shelf liner of claim 8 wherein each of the sidewall dividers include a second securing member having a first resilient lip and a second resilient.

10. The shelf liner of claim 9 including a further shelf liner secured to the second securing member of the first sidewall divider.

11. The shelf liner of claim 9 wherein the lengths of the second resilient lips of the first and second securing members are longer than the lengths of the first resilient lips of the first and second securing members to provide further support for securing the sidewall dividers to the shelf liner.

12. A shelf liner comprising:

a base for supporting products, said base having a first end, a second end, a first side and a second side;

a panel having a first edge and a second edge, said panel secured to said base, said panel having a first display area and a second display area for displaying information;

a first panel lip and a second panel lip, said first panel lip spaced from said second panel lip;

a T-shaped lip, said T-shaped lip spaced from said first panel lip and said second panel lip, said T-shaped lip coacting with said first panel lip to slidably secure a first information strip to the first display area, said T-shaped lip coacting with the second panel lip to slidably secure a second information strip to the second display area; and a first sidewall divider and a second sidewall divider, each of said sidewall dividers having a first securing member comprising a first resilient lip and a second resilient lip and a central elongated member, the first securing member of said first sidewall divider securing the first sidewall divider along the first side of said base, the first securing member of said second sidewall divider securing the second sidewall divider along the second side of said base to form a compartment therebetween.

13. The shelf liner of claim 12 wherein said panel is secured to said base at an acute angle with respect to a portion said panel located proximate the first edge of said panel.

14. The shelf liner of claim 12 wherein the base is located between the first edge and the second edge of said panel.

15. The shelf liner of claim 12 wherein the length of the second resilient lip of the first securing member is longer than the lengths of the first resilient lips of the first securing members to provide further support for the securement of the sidewall dividers to the shelf liner.

16. The shelf liner of claim 12 wherein said sidewall dividers include a second securing member.

17. The shelf liner of claim 16 including a second shelf liner connected to said first sidewall divider and a third shelf liner connected to the second sidewall divider to form a series of shelf liners.

18. The shelf liner of claim 17 wherein a width of the third shelf liner is less than a width of second shelf liner.

19. A shelf liner comprising:

a base for engaging a shelf surface, said base having a first side and a second side;

a panel having a first edge and a second edge, said panel having a first display area and a second display area for displaying information; said panel having a plurality of lips located thereon for slidably securing a first information strip to the first display area and for slidably securing a second information strip to the second display area;

a central member, said central member connecting said base to said panel; and a first sidewall divider and a second sidewall divider, each of said sidewall dividers having an elongated member and a securing member comprising a first resilient lip and a second resilient lip, the resilient lips of the first sidewall member frictionally engaging said base to secure said first sidewall divider along the first side of said base and the resilient lips of the second sidewall member frictionally engaging said base to secure said second sidewall divider along the second side of said base to thereby form a compartment between the sidewall dividers.

* * * * *